US009113687B2

(12) United States Patent
Guidry

(10) Patent No.: US 9,113,687 B2
(45) Date of Patent: Aug. 25, 2015

(54) MAGNETIC LOCKING DEVICE SYSTEM AND METHOD

(71) Applicant: Brian Christopher Guidry, Palma de Mallorca (ES)

(72) Inventor: Brian Christopher Guidry, Palma de Mallorca (ES)

( * ) Notice: Subject to any disclaimer, the term of this patent is extended or adjusted under 35 U.S.C. 154(b) by 262 days.

(21) Appl. No.: 13/781,165

(22) Filed: Feb. 28, 2013

(65) Prior Publication Data

US 2013/0220754 A1 Aug. 29, 2013

Related U.S. Application Data

(60) Provisional application No. 61/604,215, filed on Feb. 28, 2012.

(51) Int. Cl.

| | |
|---|---|
| ***A45C 13/10*** | (2006.01) |
| ***A45C 7/00*** | (2006.01) |
| ***A45C 13/00*** | (2006.01) |
| ***A45C 13/28*** | (2006.01) |
| *A45C 13/26* | (2006.01) |
| *A45C 13/30* | (2006.01) |

(52) U.S. Cl.

CPC ..... *A45C 13/1069* (2013.01); *A45C 7/0045* (2013.01); *A45C 13/001* (2013.01); *A45C 13/28* (2013.01); *A45C 13/262* (2013.01); *A45C 2013/306* (2013.01)

(58) Field of Classification Search

CPC ..... A45C 13/1069; A45C 7/0045; A45C 2013/306; A45C 13/262; A45C 13/28; A45C 13/001

See application file for complete search history.

(56) References Cited

U.S. PATENT DOCUMENTS

| | | | | |
|---|---|---|---|---|
| 1,084,360 | A * | 1/1914 | Rahm | 190/108 |
| 1,521,310 | A * | 12/1924 | Moran | 190/108 |
| 5,099,968 | A * | 3/1992 | Kikuchi | 190/108 |
| 5,797,617 | A * | 8/1998 | Lin | 280/655 |
| 5,890,571 | A * | 4/1999 | Sadow | 190/102 |
| 5,951,037 | A * | 9/1999 | Hsieh et al. | 280/655 |
| 7,874,408 | B2 * | 1/2011 | Suppancig | 190/18 A |
| 2004/0074725 | A1 * | 4/2004 | Shih | 190/115 |
| 2008/0308369 | A1 | 12/2008 | Louis, Sr. | |
| 2009/0064456 | A1 * | 3/2009 | Chen | 16/113.1 |
| 2009/0223765 | A1 | 9/2009 | Bosma | |
| 2010/0059323 | A1 * | 3/2010 | Marji | 190/18 A |

FOREIGN PATENT DOCUMENTS

| | | |
|---|---|---|
| RU | 2015284 C1 | 6/1994 |
| WO | 2010/077481 A2 | 7/2010 |

OTHER PUBLICATIONS

International Search Report and Written Opinion for related international application No. PCT/US2013/028384, mailed Jun. 6, 2013, in 7 pages.

* cited by examiner

*Primary Examiner* — Tri Mai

(74) *Attorney, Agent, or Firm* — Procopio, Cory, Hargreaves & Savitch LLP

(57) ABSTRACT

A magnetic connection system for luggage or other bags. This invention involves a method for manufacturing and using a magnetic locking device system for attaching a bag to a pull-handle or other telescoping tubular device of a wheeled bag. This system allows two bags to easily be secured together, quickly and efficiently while a traveler is on the go. If the traveler wishes to remove the second bag from the wheeled luggage, they merely need to depress the release button on the pull-handle thus removing the magnetic force which connects the two bags together through the connection with the locking pin, the mount and the auxiliary attachment adaptor.

17 Claims, 13 Drawing Sheets

MAGNETIC LOCKING DEVICE SYSTEM AND METHOD

CROSS-REFERENCE TO RELATED APPLICATIONS

This application claims the benefit of U.S. Provisional Patent Application Ser. No. 61/604,215, filed Feb. 28, 2012, entitled "Magnetic Locking Device for Attaching an Auxiliary Item to a Pull-handle Wheeled Luggage Case" which is hereby incorporated by reference in its entirety.

FIELD OF THE INVENTION

The present invention relates, in general, to a magnetic locking device system for attaching an auxiliary item to a pull-handle wheeled bag or other item.

BACKGROUND OF THE INVENTION

It is common practice among travelers to carry more than one piece of luggage generally one large piece (referred to herein as "wheeled luggage") and a smaller auxiliary piece of luggage (referred to herein as an "auxiliary item" or "bag"). This invention could also be used to connect together any two items if one has a pull-handle and wheels. This auxiliary item could be, for example, a cosmetic bag, overnight bag, messenger bag or brief case. Generally the traveler places this auxiliary item on the wheeled luggage case by seating it on top of the case and sometimes strapping it to the extended handle. With this arrangement, especially with a single tube handle, rapid movement and turning of the wheeled luggage case can cause the auxiliary item to slide or twist away from its desired position on the wheeled luggage. It is cumbersome and time consuming to fasten and undo the strap attached to the handle. Further, the bag is not securely attached and can be easily stolen by a passerby.

Devices allowing two pieces of luggage to be attached to one another have been around for decades however none solve the problems with the auxiliary item sliding or twisting away from its desired position or being cumbersome and time consuming to attach and detach. With current devices which attach the auxiliary item to the pull-handle or a telescoping handle of the wheeled luggage, rapid movements and quick turns of the traveler cause the auxiliary item to slide off the top of the wheeled luggage. In this description the wheeled luggage has a pull-handle, this pull-handle can either have a single tube arrangement or multiple tubes, a multi-tube pull-handle will be referred to as a telescoping handle. The instant invention can function with either a single tube pull-handle or a multi-tube telescoping handle.

Inventions that modify auxiliary bags to solve the problem of sliding generally include a strap or pocket on the back side of the auxiliary bag. This strap is placed over the telescoping pull-handle of a wheeled luggage case in order to secure the auxiliary bag on top of the luggage. The problem with these systems is that the auxiliary bag can be very difficult to place over the telescoping pull-handle and the user generally has to use two hands with this operation. Auxiliary bags with straps also tend to slide off of the center of the wheeled luggage bag or other item creating both inconvenience and loss of time for the traveler. Even this method does not solve the problem of potential theft.

Other inventions such as support bars fixed on the telescoping luggage handle or the wheeled luggage case itself attempt to solve the problem of preventing the auxiliary bag from twisting during travel. These inventions also do not provide significant added value to the user as they often require the user to activate additional parts on the telescoping pull-handle or wheeled luggage case apart from the telescoping pull-handle (such as supporting arms). These systems require more time from the user to set the auxiliary bag properly on the wheeled luggage case. Besides the loss of time in activating the supporting structures, additional supports often become intangled with the auxiliary bag's support strap or carrying straps, adding to the user's inconvenience.

There is, thus, a need for a magnetic locking device system and method to allow users to easily attach and detach auxiliary items to a pull-handle and item with wheels. This invention will prevent auxiliary items from twisting or falling off of the wheeled item when locked into place, is very user friendly, and assists in preventing theft of the auxiliary bag.

SUMMARY OF THE INVENTION

This invention involves a method for manufacturing and using a magnetic locking device system for attaching an auxiliary item to a pull-handle or other telescoping tubular device of a wheeled bag or other wheeled item. This system allows two bags to easily be secured together, quickly and efficiently while a user is on the go.

The object of the present invention is to provide a device for attaching two items together securely so that the auxiliary item does not move or shift and is securely snapped to the wheeled item. In a preferred embodiment this invention would be used by a traveler with two bags, wherein one bag is a wheeled piece of luggage and the other is a second bag also referred to as an auxiliary item. This device allows the two bags to be attached and detached from one another quickly thus eliminating defects and drawbacks encountered in the prior art. The magnetic locking device system includes a wheeled piece of luggage with a pull-handle, one or more auxiliary bags, a magnetic locking pin located inside a luggage pull-handle tube controlled by an operating button, a locking pin hole on the handle, a mount located on the exterior surface of the pull-handle on top of the pin hole, and an auxiliary item attachment adaptor attached to at least one surface of a second bag.

The system is used when a traveler snaps the second bag's auxiliary item attachment adaptor into the mount on the pull-handle of the wheeled luggage thus effectively attaching the two pieces together. If the traveler wishes to remove the second bag from the wheeled luggage, they merely need to depress the release button on the pull-handle thus removing the magnetic force which connects the two bags together through the connection with the locking pin, mount and auxiliary attachment adaptor.

Although there are other systems for attaching auxiliary items to wheeled luggage this magnetic locking device is unique in that it allows the auxiliary bag to be rapidly attached to the wheeled luggage, the attachment of the two bags can be done with one hand, the auxiliary bag will not fall off the wheeled luggage once it is snapped in place, the auxiliary item can be quickly removed from the wheeled luggage, the operating button of the pull-handle controls both the refraction of the pull-handle and also the locking and unlocking of the mount (which is explained in detail below) on the wheeled luggage to the auxiliary item attachment. In this system the pull-handle and attached mount can be fully retracted into the wheeled bag and stored in the bag when the handle is in its down position.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

DETAILED DESCRIPTION OF PREFERRED EMBODIMENTS

After reading this description it will become apparent to one skilled in the art how to implement the invention in various alternative embodiments and alternative applications. However, all the various embodiments of the present invention will not be described herein. It is understood that the embodiments presented here are presented by way of an example only, and not limitation. As such, this detailed description of various alternative embodiments should not be construed to limit the scope or breadth of the present invention as set forth below.

The magnetic locking device is a system which allows two pieces of luggage or other items to be securely attached together, quickly and easily when a person is traveling. It should be understood that this invention can be used with any item which has wheels and a pull-handle, however for the ease of description herein the preferred embodiment of two pieces of luggage shall be described below. The magnetic locking device includes a magnetic locking pin controlled by an operating button located in the pull-handle of an item of wheeled luggage, a magnetic locking pin hole which allows the locking pin to extrude from the handle or retract into the handle when the operating button is pressed, and an attachment mount located on the exterior surface of the pull-handle which can retract into the wheeled luggage with the handle and that connects and snaps into a auxiliary item attachment adaptor connected to the outside of a second bag. The magnetic locking device system is used by placing a second bag or auxiliary piece of luggage on top of a wheeled luggage bag with a mount on the outside of the handle and snapping the attachment adaptor to the auxiliary piece of the luggage. It is very easy to release the auxiliary item from the wheeled luggage by easily depressing the operating buttons located on the telescoping pull-handle; based on this, it enables a traveler to easily snap together two pieces of luggage on the go and release them quickly to take them a part. The following is a detailed description of the magnetic locking device system and the method of using the same.

Figure 1:
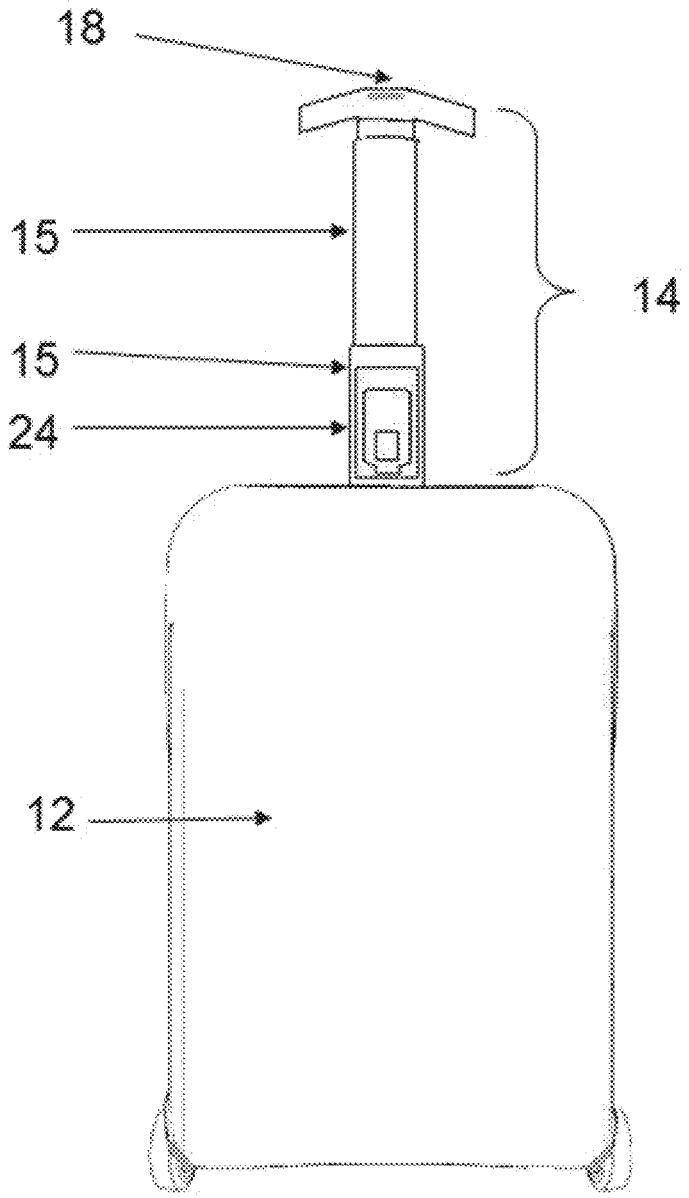
FIG. 1 is a perspective view of one embodiment of the mount of the magnetic locking device located on the pull-handle tube of a piece of wheeled luggage.
Figure 2:
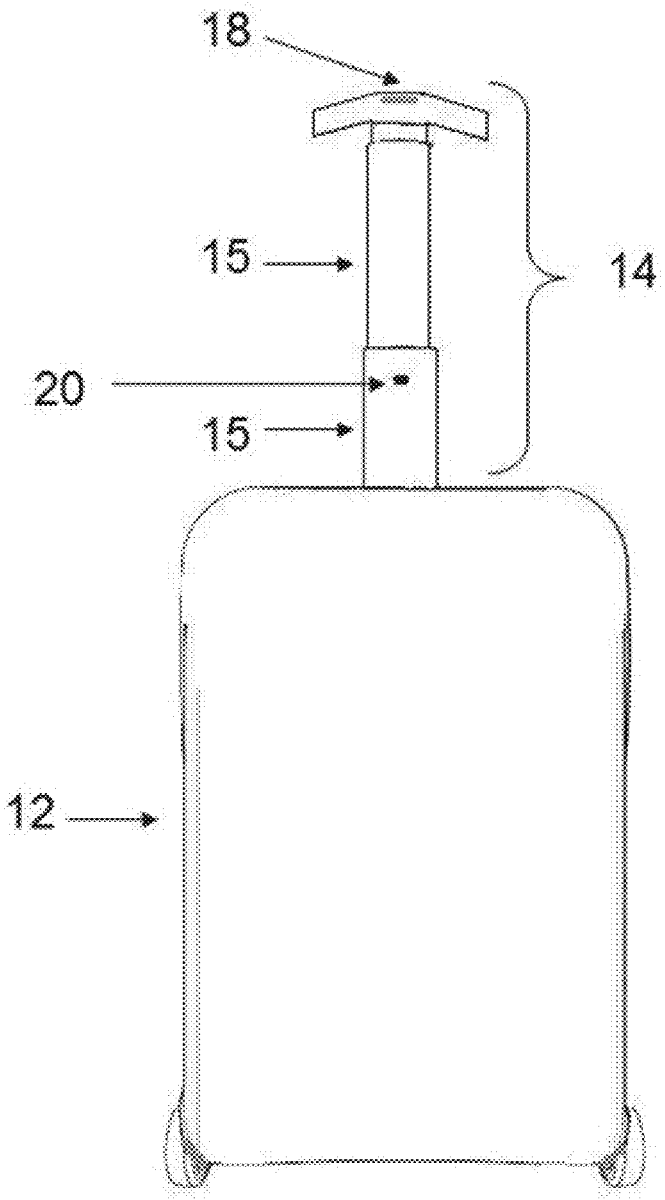
FIG. 2 is a view of a wheeled luggage showing the pull-handle without an attached mount showing the locking pin hole.
Figure 12A:
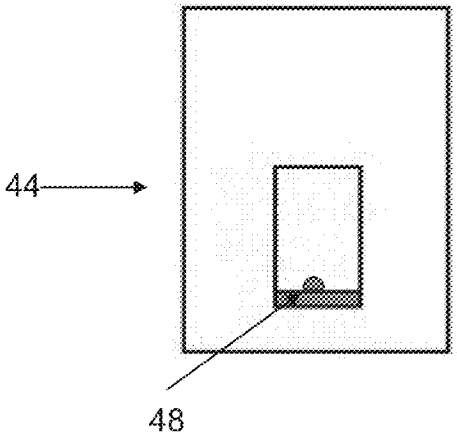
FIG. 12A is a rear view of the attachment adaptor.

With reference to FIG. 1, a wheeled piece of luggage 12 is seen with the pull-handle 14 being extended and an auxiliary item mount 24 attached to the exterior surface of the pull-handle 14. The extended position is the position the handle 14 would be in when an auxiliary item 42 is connected to the wheeled luggage 12. Auxiliary item mount 24 quickly snaps into the auxiliary item attachment adaptor 44 (FIG. 3) located on a second bag 42. The auxiliary item mount 24 and auxiliary item attachment adaptor 44 need to be the same shape so that they can connect together, if the attachment adaptor 44 is of a different shape it can be modified to fit the auxiliary item mount 24 by the use of a form adaptor 46 (FIG. 12A). FIG. 2 shows the outside of the wheeled luggage with a locking pin hole which will be described below. The auxiliary item mount sits on top of the locking pin hole 20. The pull-handle 14 is comprised of one or more tubes 15, a locking pin 16 with internal mechanism for control (one embodiment described below), a locking pin hole 20, and an operating button 18 which controls the extension and retraction of the locking pin. A pull-handle 14 with multiple tubes 15 is referred to as a telescoping pull-handle.

FIG. 1 shows one embodiment of an auxiliary item mount 24 on a telescoping pull-handle 14 of a wheeled luggage case 12. The auxiliary item mount 24 may be constructed individually and fixed to the pull-handle 14 or be formed as a single piece with the pull-handle 14. The auxiliary item mount 24 is shown in a rectangular shape however it may also be constructed in different shapes in order to be compatible with different auxiliary item attachment adaptors 44 (explained below). The auxiliary item mount 24 can also be constructed from a variety of materials such as plastic or metal among others.

Figure 3:
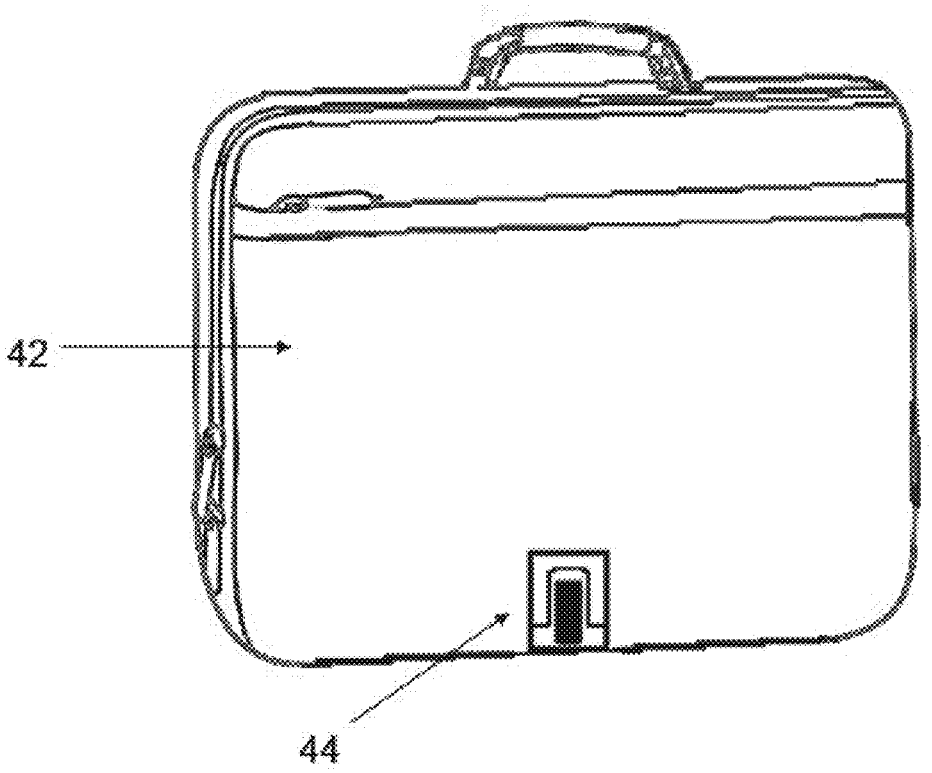
FIG. 3 is a perspective view of an auxiliary item with an attachment adaptor.
Figure 5B:
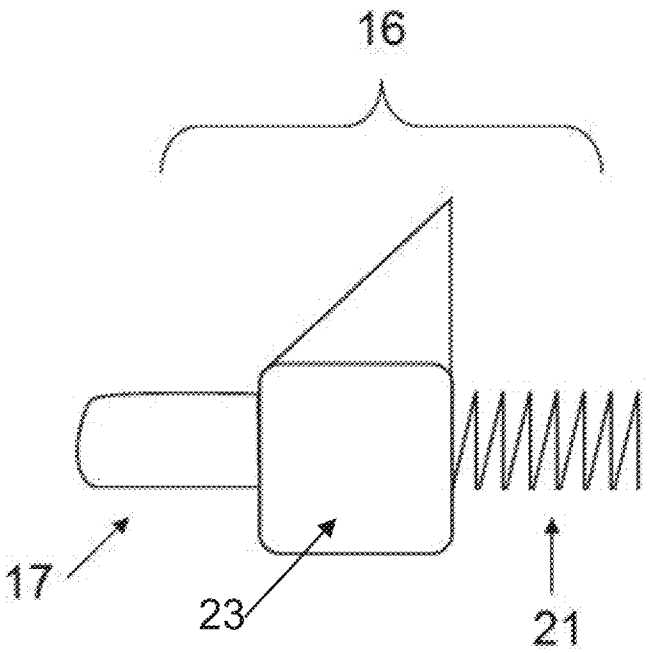
FIG. 5B is a side view of a one embodiment of a magnetic locking pin.
Figure 9B:
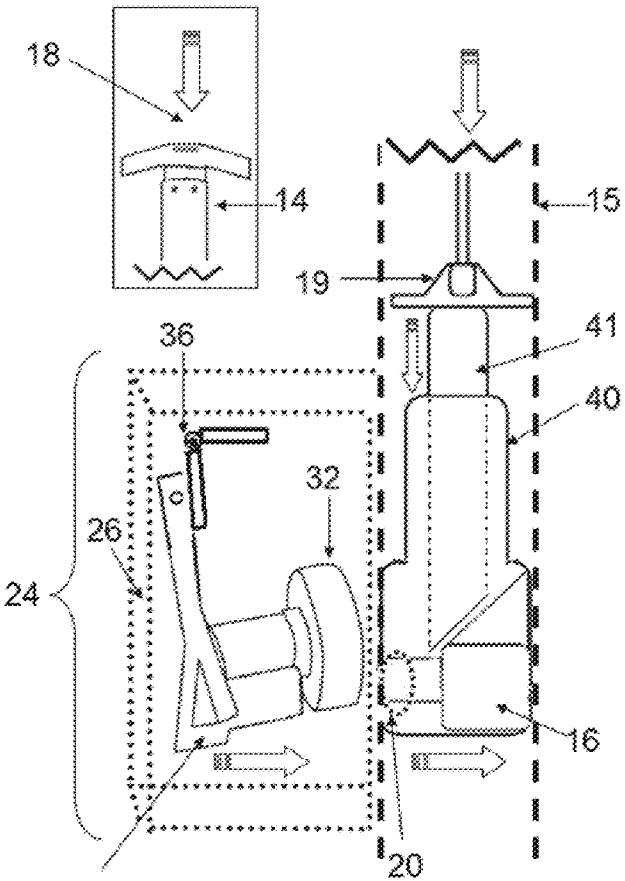
FIG. 9B is a cross-sectional view of one embodiment of the auxiliary item mount on the telescoping tube of a pull-handle wheeled luggage case with the locking pin retracted.
Figure 9A:
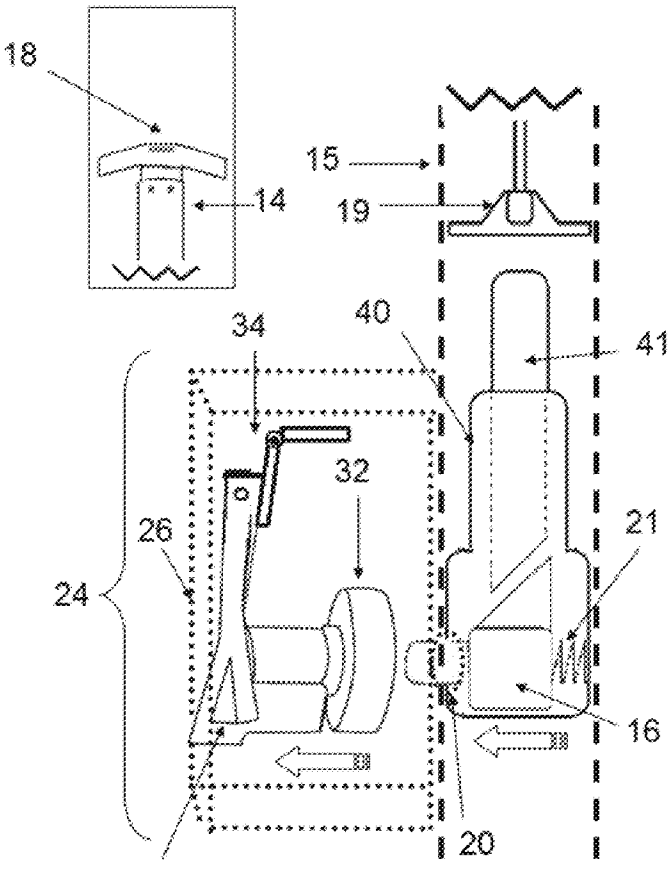
FIG. 9A is a cross-sectional view of one embodiment of the auxiliary item mount on the telescoping tube of a pull-handle wheeled luggage case with the locking pin extruding.

The telescoping pull-handle 14 is raised and lowered using the operating button 18, which in this embodiment sits on top of the handle. The operating button 18 when depressed causes the locking pin to retract which releases the auxiliary attachment adaptor 44 from the auxiliary item mount 24 and allows the second bag 42 to be removed and the handle 14 and auxiliary item mount 24 to be retracted into the wheeled luggage case 12. FIG. 2 illustrates the wheeled piece of luggage with the telescoping handle extended and the auxiliary item mount 24 removed to reveal locking pin hole 20 on the front of the lowermost telescoping tube 15. As illustrated, the handle comprises telescopically engaged tubes 15 where the lower telescoping tube is of larger cross-sectional dimensions than the uppermost tube 15 to which handle 18 is attached. The locking pin hole 20 located on the front of the telescope tube 15 allows for internal magnetic locking pin 16 (as shown in FIGS. 5B, 9A and 9B) to lock the telescoping tubes 15 in order to prevent the telescoping pull-handle from being lowered. In the illustrated embodiment, the auxiliary item mount 24 is attached in front of hole 20 in the lowermost tube 15 as seen in FIG. 1, and the same pin 16 locks the tubes 15 of the pull handle in the extended position and moves locking switch 30 of auxiliary item mount 24 between extended and retracted positions, as described in more detail below in connection with FIGS. 9A and 9B. FIG. 3 shows an auxiliary item 42 with an attached auxiliary attachment adaptor 44 on the lower backside.

Figure 4C:
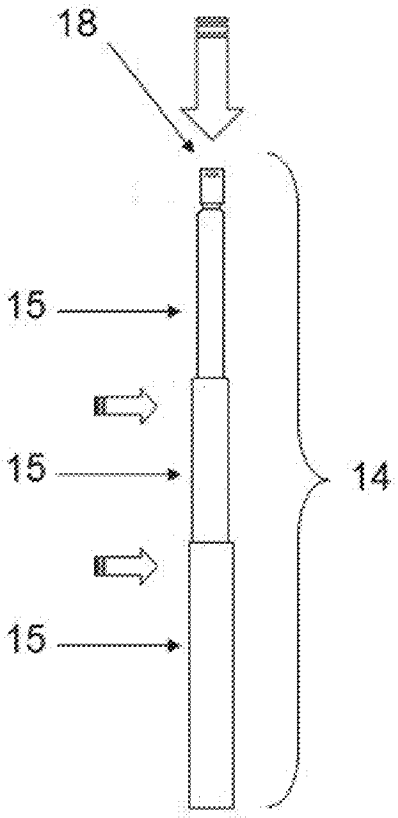
FIG. 4C is a side view of one embodiment of a telescoping pull-handle for a wheeled luggage case after the operating button on the handle has been pressed; the handle is shown in the unlocked position where the locking pins have moved inside of the telescoping tube to allow for the handle to be lowered.
Figure 4B:
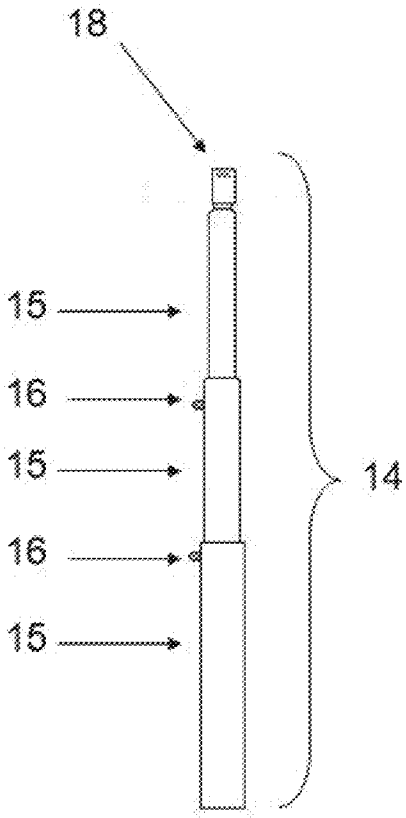
FIG. 4B is a side view of one embodiment of a telescoping pull-handle for a wheeled luggage case; the handle is shown in the locked position where the extruding locking pins prevent the handle from being lowered.
Figure 4A:
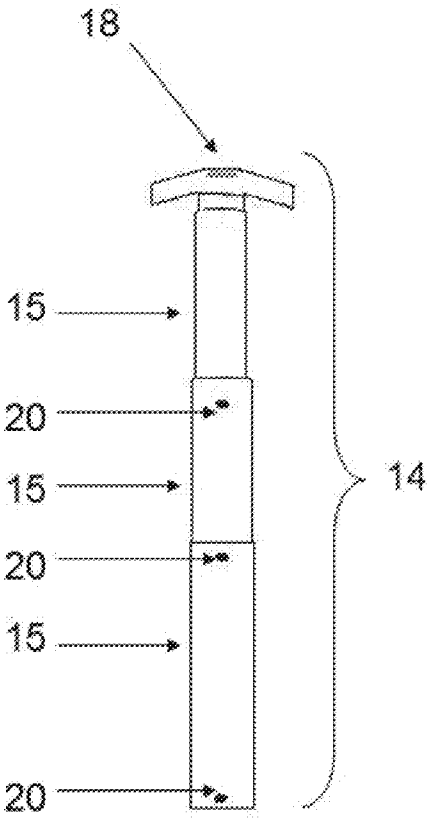
FIG. 4A is a front view of one embodiment of a telescoping pull-handle for a wheeled luggage case.

FIG. 4A-4C shows the functionality and components of a telescoping pull-handle 14. FIG. 4A shows a front view of a multi-tube telescoping pull-handle 14, it has three tubes which retract into one another and ultimately into the wheeled bag 12. The interlocking pin hole 20 is located on the telescoping tubes 15. FIG. 4B shows a side view of the telescoping pull-handle 14 shown in a locked position. Here the magnetic locking pin 16 extrudes from the telescoping tube 15, in this position, the user is unable to retract a pull-handle 14 into the wheeled luggage case 12 as it is locked in position ready to have an auxiliary item attached.

FIG. 4C is a side view of one embodiment of a telescoping pull-handle 14 shown in the unlocked position. When the user presses operating button 18 on the pull-handle 14, the magnetic locking pins 16 are retracted inside telescoping tubes 15. In this position, the user is able to lower the telescoping pull-handle 14 into the wheeled luggage case 12 and release an auxiliary bag 42 if one is attached to the mount 24 (FIG. 1) (not shown here).

Figure 5A:
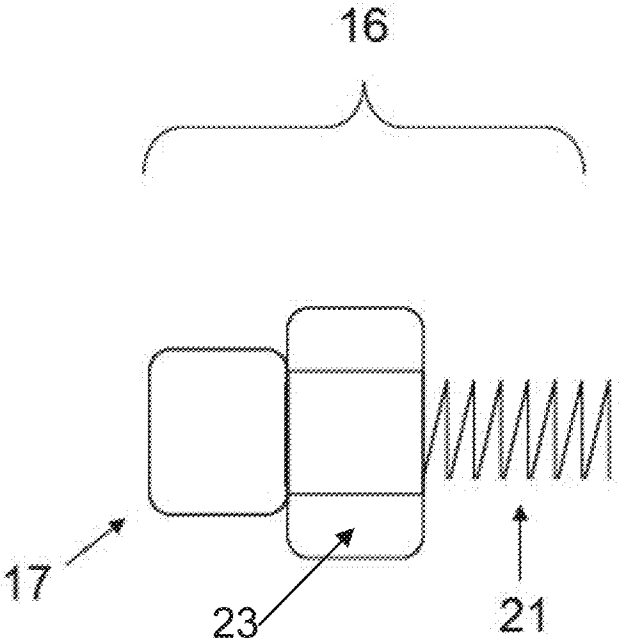
FIG. 5A is a top view of one embodiment of a magnetic locking pin.

FIGS. 5A and 5B illustrate one embodiment of a magnetic locking pin 16, which is a key component of the instant invention. The magnetic locking pin 16 is constructed with a magnetic locking pin tip 17 that can extend from the tube 15 or telescoping tubes 15 when it is in the locked position (as seen in FIG. 4B) or retract inside of the innermost telescoping tube 15 when it is in the unlocked position by the means of the operating button 18 (as seen in FIG. 4C). In the embodiment of the locking pin shown here the locking pin 16 includes a spring 21, locking pin base 23, and magnetic locking pin tip 17. In this embodiment, the magnetic locking pin tip 17 has been threaded and screwed inside of the locking pin base 23. Numerous embodiments of the magnetic locking pin 16 are possible so that it is compatible with different internal mechanisms of the telescoping pull-handle 14. Other examples would be constructing the magnetic locking pin tip 17 and locking pin base 23 as a single piece or using glue or adhesives to attach the magnetic locking pin tip 17 to the locking pin base 23. Both the magnetic locking pin 16 and locking pin base 23 can also be constructed with a variety of materials (aluminum, steel, iron, titanium, plastic, resin, so long as the magnetic locking pin tip 17 is magnetic) and be made in different shapes and sizes. The magnetic locking pin 16 may be joined to the magnetic locking pin tip 17 by a number of means, including but not limited to fusing, gluing welding, and soldering; in the alternative the magnetic locking pin 16 and magnetic locking pin tip 17 can be constructed as one single piece.

Figure 6:
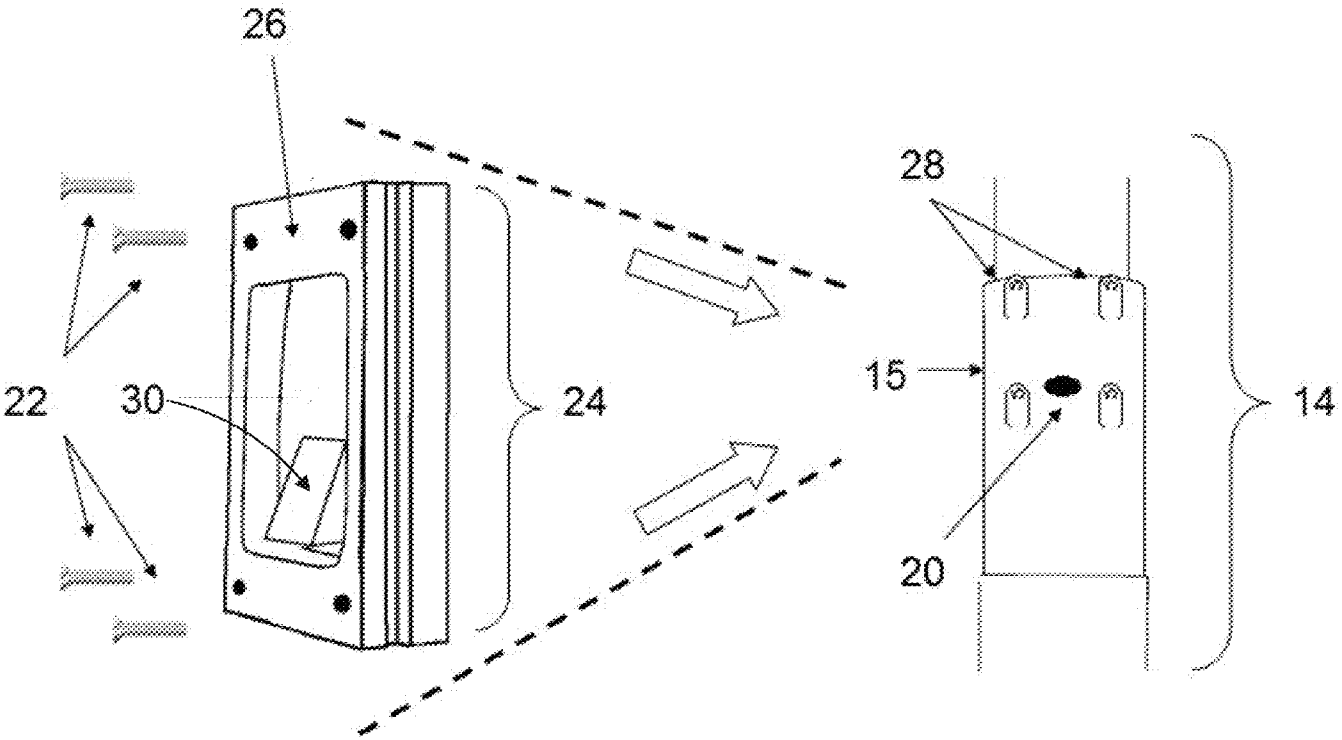
FIG. 6 is one embodiment of how the auxiliary item mount can be fixed to the telescoping tube of a pull-handle wheeled luggage case.

FIG. 6 shows one embodiment of how the auxiliary item mount 24 can be fixed on the tube 15 of a pull-handle 14. With each embodiment, the auxiliary item mount 24 must be positioned on top of the locking pin hole 20 in order to allow for the magnetic connection between the locking switch 30 and the magnetic locking pin 16 (explained below). In this embodiment, the tube 15 is made with auxiliary item mount studs 28 that the auxiliary item mount 24 can be screwed into. Other embodiments for fixing the auxiliary item mount 24 to the telescoping tube 15 include welding, soldering, gluing, and adhesives among others. The auxiliary item mount can also be constructed in a way that it fully surrounds the tube 15 so that it can be clamped in place.

Figure 7:
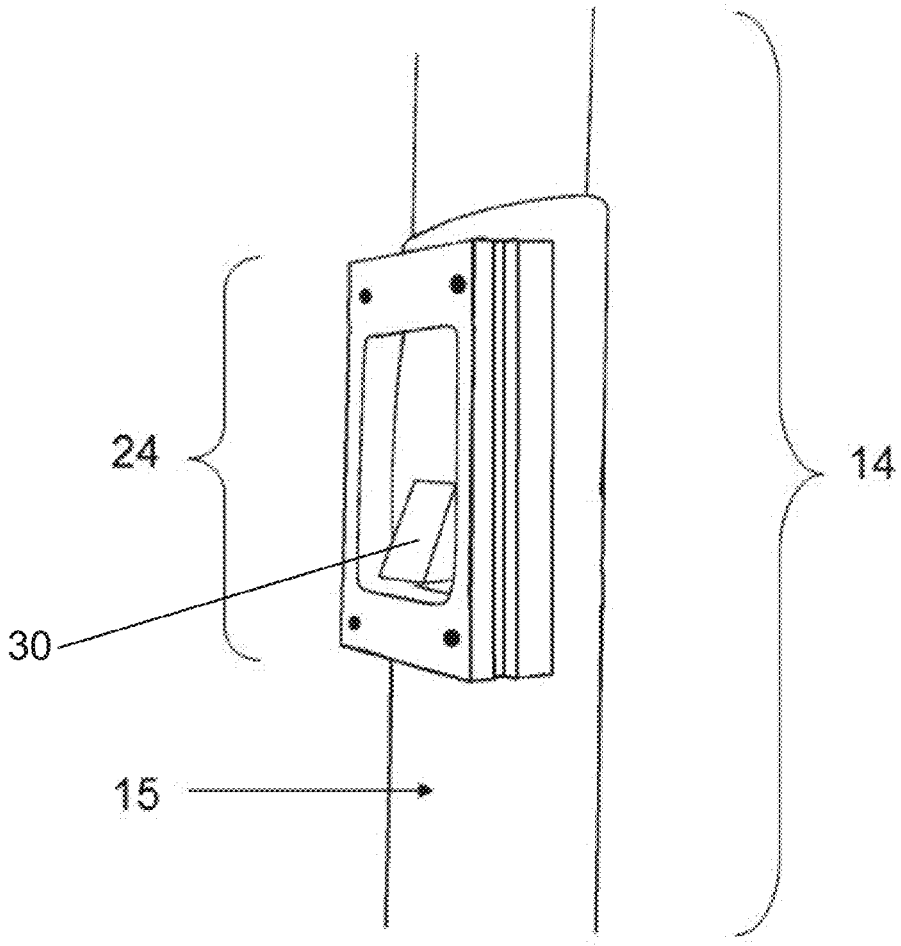
FIG. 7 is a side view of one embodiment of the auxiliary item mount on the telescoping tube of a pull-handle wheeled luggage case.

FIG. 7 is a side view of one embodiment of the auxiliary item mount 24 on the tube 15. The locking switch 30 is shown in the locked position. The auxiliary item mount 24 covers the locking pin hole 20 (shown in FIG. 2) on the pull-handle 14. In the embodiment shown in FIG. 7, the mount 24 is attached via four screws to the tube 15.

Figure 8:
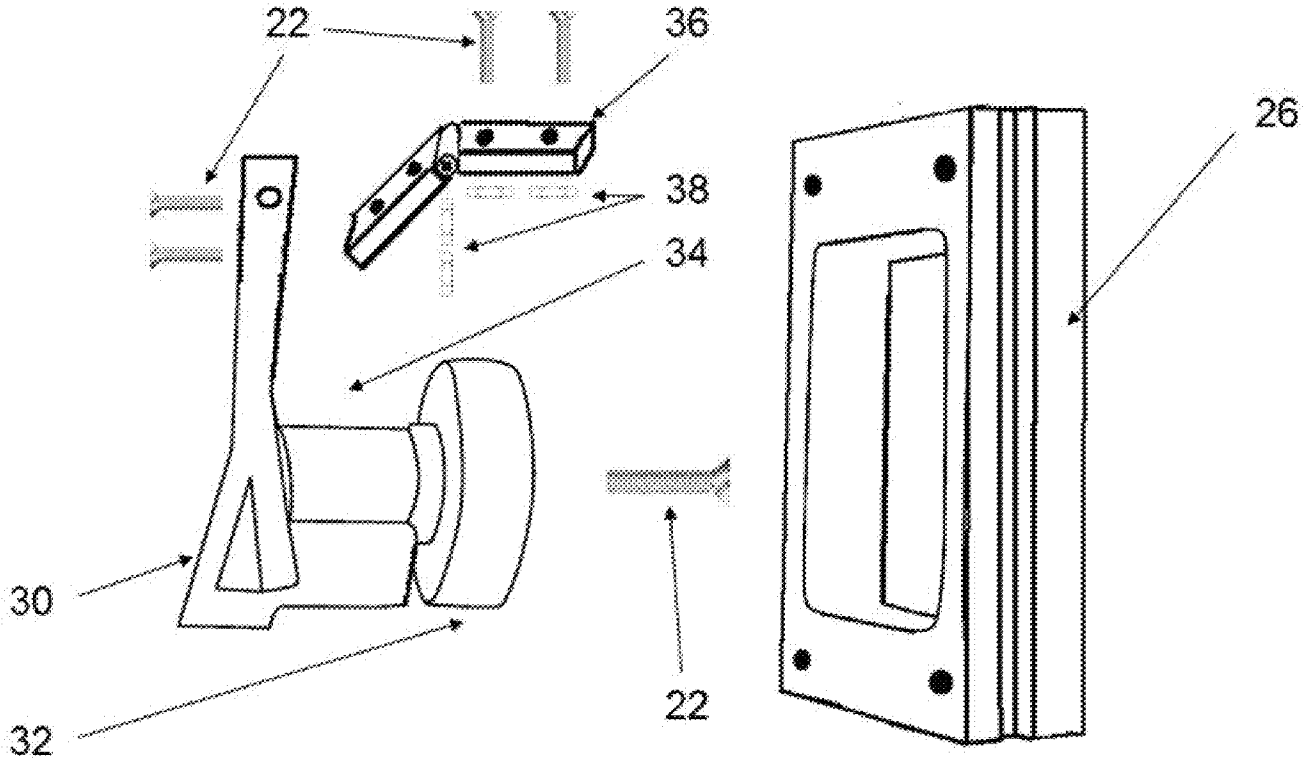
FIG. 8 is the component parts of one embodiment of the auxiliary item mount.

FIG. 8 shows one embodiment of how the auxiliary item mount 24 can be constructed. A switch magnet 32 is attached to a locking switch 30 via a switch magnet mount 34. The locking switch 30 and switch magnet mount 34 can also be constructed as a single piece. The locking switch 30 is then attached inside of an auxiliary item mount frame 26 using a hinge 36. The locking switch 30 may be attached to the inside of the auxiliary item mount frame 26 by a number of means so long as the locking switch 30 is able to pivot forward and backward inside of the auxiliary item mount frame 26.

FIG. 9A is a cross-sectional view of the auxiliary item mount 24 attached to the pull-handle 14. The locking pin 16 is shown in the tube 15 of the pull-handle 14. The auxiliary item mount 24 is shown in the locked position. Here, the magnetic locking pin 16 extrudes through the locking pin hole 20 because of the outward pressure exerted on the magnetic locking pin 16 by the spring 21. In this position, the magnetic locking pin 16 magnetically connects to the switch magnet 32 and pushes the attached locking switch 30 outside of the auxiliary item mount frame 26. If an auxiliary bag 42 with auxiliary item attachment adaptor 44 (shown in FIGS. 10A and 10B) was rested on top of the auxiliary item mount 24 at this stage, it would be locked into place as the locking switch 30 would engage with the auxiliary item attachment adaptor 44.

The extruding and retracting movement of magnetic locking pin 16 is controlled by the operating button 18 on top of the telescoping pull-handle 14. There are various internal mechanisms for controlling the extruding and retracting movement of the magnetic locking pin 16 itself and this mechanism is out of the scope of the present invention. However, in some embodiments this movement is controlled by a retraction controller 40, retraction controller shaft 41 and internal control rod 19 as shown in FIGS. 9A and 9B. When the user presses the operating button 18, downward pressure is exerted on the retraction controller shaft 41 by means of the internal control rod 19. As the internal control rod 19 is depressed, the reaction controller shaft 41 makes contact with the magnetic locking pin 16 and pushes the magnetic locking pin tip 17 inside of the telescoping tube 15. In this position, the spring 21 is compressed allowing the magnetic pin 16 to be fully housed inside of the telescoping tube 15.

Both FIGS. 9A and 9B show the magnetic locking pin 16 located inside of a retraction controller 40. The retraction controller 40 is just one of the several stated internal mechanisms that could be compatible with this invention. For the invention to function properly, the magnetic looking pin 16 and auxiliary item mount 24 must be used in conjuncture with a pull-handle 14 with an internal locking pin mechanism.

FIG. 9B is a cross-sectional view of the auxiliary item mount 24 attached to the pull-handle 14. The auxiliary item mount 24 is shown in the unlocked position. When the user presses the operating button 18 on the telescoping pull-handle 14, the retraction controller 40 (or similar internal mechanism) draws the magnetic locking pin 16 inside of telescoping tube 15. Because of the magnetic contact between the magnetic locking pin 16 and the switch magnet 32, the adjoining locking switch 30 is also drawn inside of the auxiliary item mount frame 26. When the locking switch 30 is drawn inside it releases the connection with the auxiliary adaptor 44 thus releasing the second bag 42 to from the wheeled luggage 12.

Figure 10B:
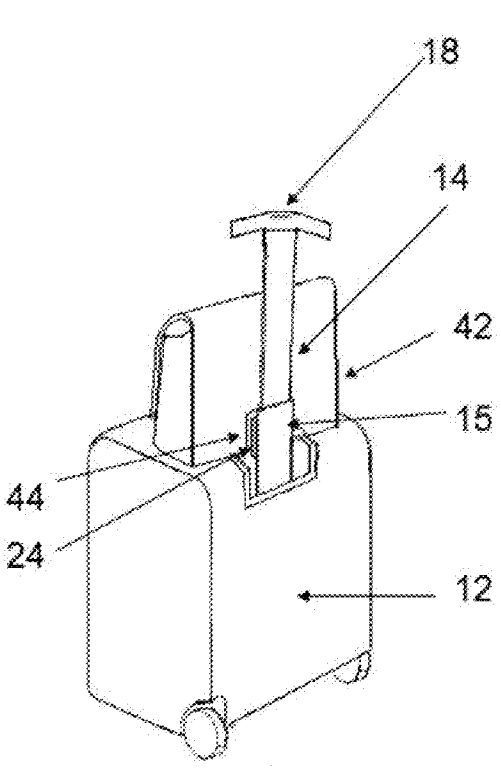
FIG. 10B shows an auxiliary bag with an auxiliary item attachment adaptor locked on one embodiment of the pull-handle of a wheeled luggage case.
Figure 10A:
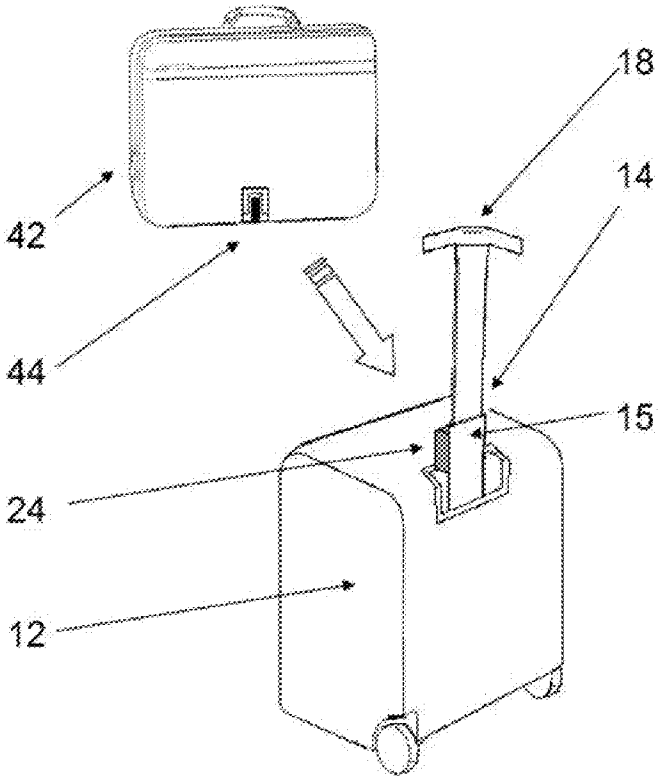
FIG. 10A shows an auxiliary bag with an auxiliary item attachment adaptor being placed on top of a wheeled luggage case with one embodiment of an auxiliary item mount on the telescoping pull-handle.

FIG. 10A is an auxiliary bag 42 with auxiliary item attachment adaptor 44 being placed on the auxiliary item mount 24 of the wheeled luggage case 12. In order to secure the auxiliary bag 42 on top of the wheeled luggage case 12, the user must guide the auxiliary item attachment adaptor 44 on top of the auxiliary item mount 24. The auxiliary item attachment adaptor 44 must be the same shape as the auxiliary item mount 24 in order to function properly. The two parts function as a male and female adaptor where the auxiliary item attachment adaptor 44 is placed on top of the auxiliary item mount 24.

FIG. 10B shows the auxiliary bag 42 with auxiliary item attachment adaptor 44 that is secured on top of the auxiliary item mount 24 of the wheeled luggage case 12. Here the auxiliary bag 42 is locked into place and cannot be removed from the wheeled luggage case 12 unless the traveler presses the operating button 18.

Figure 11B:
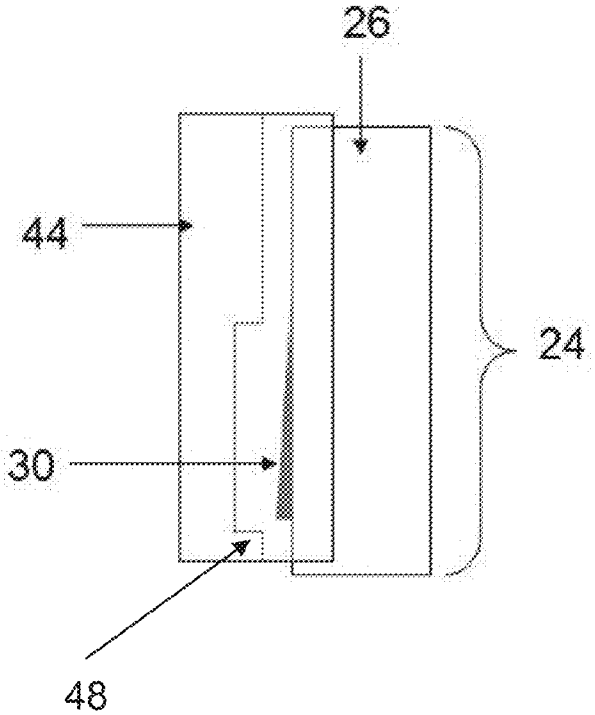
FIG. 11B is a cross-sectional view of an auxiliary item attachment adaptor that has been placed on top of one embodiment of an auxiliary item mount. The magnetic locking switch is shown in the unlocked position.
Figure 11A:
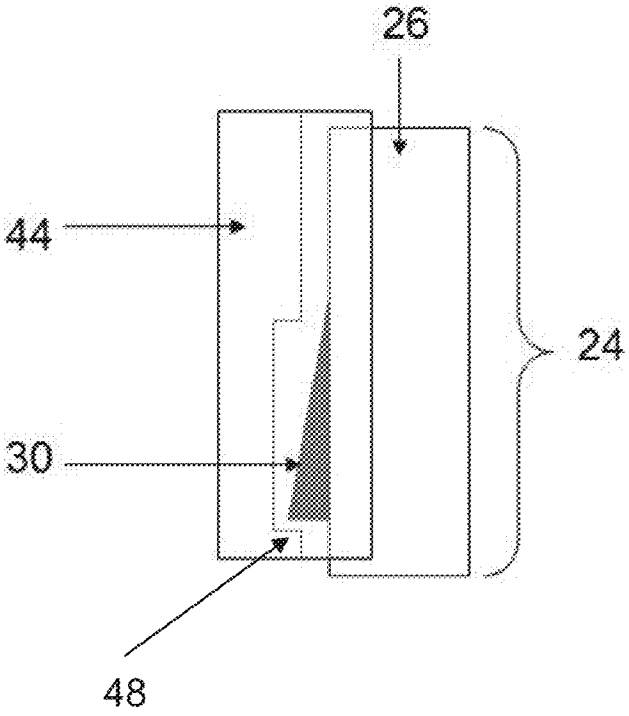
FIG. 11A is a cross-sectional view of an auxiliary item attachment adaptor that has been placed on top of one embodiment of an auxiliary item mount. The magnetic locking switch is shown in the locked position.

FIG. 11A is a cross-sectional view showing the auxiliary item adaptor 44 locked on top of the auxiliary item mount 24. The locking switch attachment 30 is engaged and prevents the user from removing the auxiliary bag 42 from the wheeled luggage case 12 (as shown in FIG. 10B).

FIG. 11B is a cross-sectional view showing the auxiliary item attachment adaptor 44 on top of the auxiliary item mount 24 in the unlocked position. The locking switch 30 is disengaged and allows the user to remove the auxiliary bag 42 from the wheeled luggage case 12 (as shown in FIG. 10A).

Figure 12B:
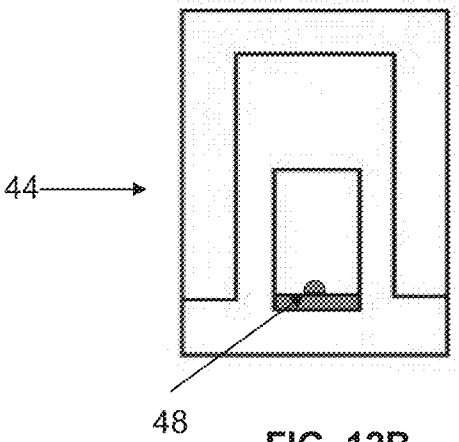
FIG. 12B is a front view of the attachment adaptor.
Figure 12C:
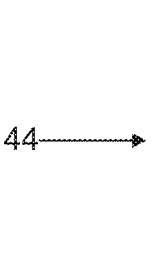
FIG. 12C is a side view of the attachment adaptor without a catch plate.
Figure 12D:
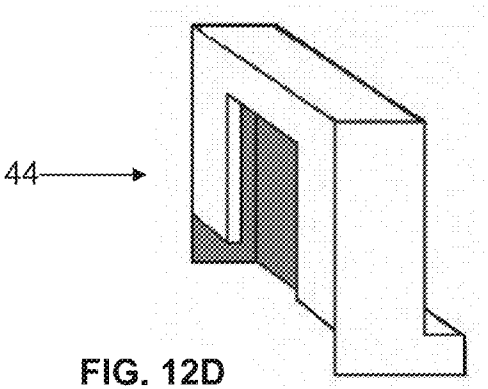
FIG. 12D is an angled view of the attachment adaptor without a catch plate.

FIG. 12A-D shows one embodiment of an attachment adaptor 44. The attachment adaptor 44 is constructed so that it can easily be slid on top of the auxiliary item mount 24. This embodiment of the attachment adaptor 44 has been constructed as a single piece using molded plastic, although the attachment adaptor 44 could be made of various materials such as metal or resin and it could also be assembled using multiple parts. The main feature of the attachment adaptor 44 is that it has a sturdy catch plate 48 that prevents the auxiliary bag 42 from being removed from the wheeled luggage case 12 when the locking switch 30 is in the outward or locked position. The catch plate 48 can be integrated into the attachment adaptor 44 itself or added on as an additional part. The catch plate 48 can also be constructed in a variety of materials including but not limited to plastic, resin, or metal. 12A shows the rear view of the attachment adaptor. FIG. 12B is a front view of the attachment adaptor. FIG. 12C is a side view of the attachment adaptor without a catch plate. FIG. 12D is an angled view of the attachment adaptor without a catch plate.

Figure 13B:
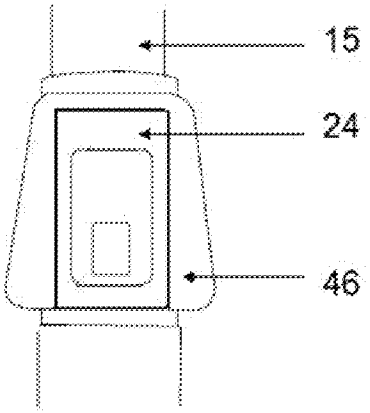
FIG. 13B is a front view of one embodiment of an auxiliary item mount with a form adaptor that has been fixed on the mount itself.
Figure 13A:
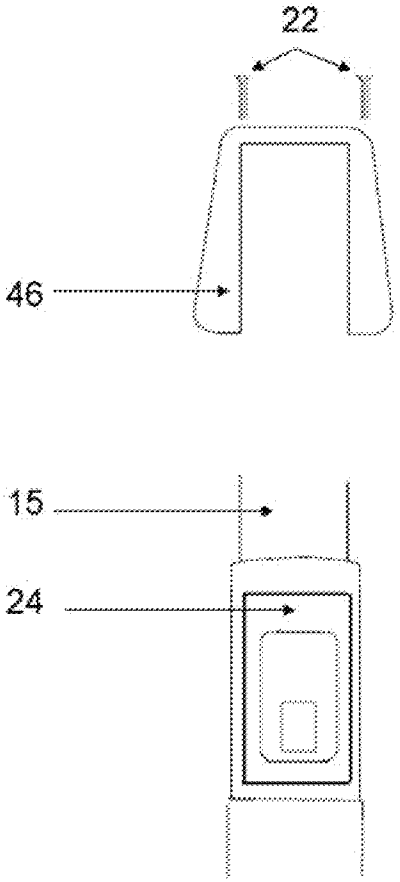
FIG. 13A is a front view of one embodiment of an auxiliary item mount and a form adaptor.

FIG. 13A is a front view of one embodiment of an auxiliary item mount 24 and a form adaptor 46. The form adaptor 46 can be affixed to a auxiliary item mount 24 to change its shape so that it will fit the auxiliary item attachment adaptor 44 of the wheeled item 12. This adaptor 46 allows a user to purchase an auxiliary item 42 which might not have the same shape as the auxiliary item mount 24 on the wheeled item 12 they want to use. The adaptor 46 solves the problem of the two different shapes allowing a different shaped auxiliary item mount 24, to have it's shape changed making it compatible with any auxiliary item attachment adaptor 44. The form adaptor 46 can be constructed in various shapes, sizes and materials so that different shaped auxiliary item attachment adaptors 44 can be snapped on to the auxiliary item mount 24.

FIG. 13B is a front view of one embodiment of an auxiliary item mount 24 with a form adaptor 46 that has been fixed on the mount itself. The form adaptor 46 can be attached to the auxiliary item mount 24 by numerous means including attachment by screws, glue, adhesives, flush fit, snap-on system, etc. The auxiliary item mount 24 itself can also be constructed in different shapes and sizes so as to avoid the use of the form adaptor 46 altogether.

Method of Use for the Magnetic Locking Device System:

The user finds himself/herself in the situation, such as in an airport or train station, where he/she would like to attach an auxiliary bag 42 to a wheeled luggage case 12. The user places the auxiliary bag 42, which is equipped with an auxiliary item attachment adaptor 44, on top of the wheeled luggage case 12 with an auxiliary item mount 24. Once the auxiliary item attachment adaptor 44 is place on top of the auxiliary item mount 24, the locking switch 30 becomes engaged (via the connection between the switch magnet 32 and the magnetic locking pin 16) and the user is not able to remove the auxiliary bag 42 from the telescoping pull-handle 14. The user is free to travel about and not worry about the auxiliary bag 42 shifting, twisting or falling off of the wheeled luggage case 12. When the user would like to remove the auxiliary bag 42 from the wheeled luggage case 12, the user presses and holds the operating button 18 that is located on the top telescoping pull-handle 14. Pressing the operating button 18 retracts the internal magnetic locking pin 16 inside of the telescoping tube 15. When the magnetic locking pin 16 is drawn inside the telescoping tube 15, the locking switch 30 is also drawn inside of the auxiliary item mount frame 26 due to the magnetic connection between the switch magnet 32 and the magnetic locking pin 16. Once the locking switch 30 is inside of the auxiliary item mount frame 26, the user is able to freely remove the auxiliary bag 42 from the wheeled luggage case 12.

The above description of disclosed embodiments is provided to enable any person skilled in the art to make or use the invention. Various modifications to the embodiments will be readily apparent to those skilled in the art; the generic principals defined herein can be applied to other embodiments without departing from spirit or scope of the invention. Thus, the invention is not intended to be limited to the embodiments shown herein but is to be accorded the widest scope consistent with the principals and novel features disclosed herein.

The invention claimed is:

1. A magnetic locking device system for a luggage item, comprising:

a wheeled bag with a pull-handle movable between a retracted position and an extended position extending out of the bag for engagement by a user in pushing or pulling the wheeled bag, the pull-handle having a releasable locking device configured for releasably locking the pull-handle in the extended position and an operating button associated with the releasable locking device and configured to release the locking device when depressed to allow the handle to retract into the bag;

an auxiliary item mount attached to the pull-handle of the wheeled item and having a releasable locking switch movable between a locking position and an unlocked position, the locking switch being configured for actuation by the pull-handle locking device for movement between the locking and unlocked positions, the locking switch being in the locking position when the pull-handle is in the extended, locked position;

one or more auxiliary bags; and an auxiliary item attachment adaptor, sized to connect with the auxiliary item mount, affixed to the surface of the one or more auxiliary bags and having a portion configured for releasable snap engagement with the locking switch of the auxiliary item mount in the extended, locked position of the pull-handle;

whereby the auxiliary item attachment adaptor of the auxiliary bag is released from the auxiliary item mount by depressing the operating button on the pull-handle.

2. The magnetic locking device system of claim 1, wherein the pull-handle is constructed of multiple tubes.

3. The magnetic locking device system of claim 1, wherein the auxiliary item mount further comprises a mount frame, a switch magnet, and a switch magnet mount, wherein the switch magnet is attached inside the mount frame and the switch magnet is attached to the locking switch via the switch magnet mount.

4. The magnetic locking device system of claim 1, wherein the auxiliary item attachment adaptor has a catch plate configured for releasable snap engagement with the locking switch when the auxiliary item attachment adaptor is connected to the auxiliary item mount in the extended, locked position of the pull-handle.

5. The magnetic locking system of claim 1, including a form adaptor which is configured to attach to the auxiliary item mount and modify its shape so that it can connect with the auxiliary item attachment adaptor.

6. The system of claim 1, wherein the pull-handle comprises at least a first tube and a second tube in telescoping engagement with one end of the first tube for movement between extended and retracted positions, the first and second tubes having first and second locking holes, respectively, the first and second locking holes being aligned in the extended position of the pull-handle, the locking device being located in the second tube and comprising a locking pin aligned with the second locking hole and a biasing device which urges the locking pin into an extended position extending through the first and second aligned locking holes in the extended position of the pull-handle, whereby the pull-handle is locked in the extended position, and the operating button being associated with the locking device to urge the locking pin into a retracted position inside the second tube when depressed, the auxiliary item mount being attached to the pull-handle over the first locking hole and the locking switch being moved into the locking position by a tip of the locking pin projecting through the first locking hole in the extended position of the locking pin.

7. A magnetic locking device system, comprising:

a wheeled bag with a pull-handle configured to move between an extended, locked position extending out of the bag and a retracted position retracted into the bag, the pull handle having an operating button configured to release the pull-handle from the locked position to allow retraction of the pull-handle into the retracted position;

the pull-handle having a magnetic locking pin, a locking pin hole aligned with the locking pin, the magnetic locking pin being movable between an operative position extending through the locking pin hole and a retracted position retracted from the hole, and a biasing device urging the magnetic locking pin into the operative position, wherein the locking pin is controlled to move into the retracted position by an operating button on the pull-handle;

an auxiliary item mount positioned on the pull-handle in communication with the locking pin hole and configured for actuation by the locking pin;

a second bag having an auxiliary item attachment adaptor connected to at least one surface; and the auxiliary item mount configured to accept and lock into the auxiliary item attachment adaptor when the pull-handle is in the extended, locked position.

8. The system of claim 7, wherein the auxiliary item mount further comprises a mount frame, a switch magnet, and a switch magnet mount, wherein the switch magnet is attached inside the mount frame and the switch magnet is attached to the locking switch via a switch magnet mount.

9. The system of claim 7, wherein the locking pin has a magnetic locking pin tip which projects through the locking pin hole in the operative position of the magnetic locking pin and retracts into the pull-handle in the retracted position of the magnetic locking pin.

10. The system of claim 9, wherein the magnetic locking pin tip is constructed from magnetic material and the remainder of the locking pin is constructed from one of the following materials: aluminum, steel aluminum, steel, iron, titanium, plastic, or resin.

11. The system of claim 7, wherein the auxiliary item mount is formed as a single piece with the pull-handle.

12. The system of claim 7, wherein the auxiliary item attachment adaptor has a catch plate.

13. The system of claim 7, including a form adaptor which is configured to attach to the auxiliary item mount and modify its shape so that it can connect with the auxiliary item attachment adaptor.

14. A method of attaching two bags together, including:

a piece of wheeled luggage with a pull-handle;

the pull-handle having an operating button which controls a magnetic locking pin;

a second bag;

an auxiliary item mount attached to the pull-handle; and an auxiliary attachment adaptor affixed to one surface of the second bag configured to snap into the auxiliary item mount;

wherein the user presses the operating button on the pull-handle of the wheeled luggage, and the depression of the button causes the retraction controller to draw the magnetic locking pin inside the pull-handle which also causes the locking switch to be drawn inside the auxiliary item mount frame causing the auxiliary item attachment adaptor to be released.

15. The method of claim 14, further comprising attaching a form adaptor to the auxiliary item attachment adaptor to modify its shape so that it can connect with the auxiliary item mount.

16. A method of attaching a wheeled bag with a retractable pull-handle to a second bag, comprising:

extending the retractable pull-handle of a wheeled bag into an extended, locked position in which a locking pin inside the handle projects through an aligned hole in the handle and moves a locking switch in an auxiliary item mount located on the handle into a locking position;

snapping an auxiliary attachment adaptor located on a second bag into the auxiliary item mount so that the locking switch engages with the auxiliary attachment adaptor to secure the second bag to the pull-handle of the wheeled bag; and releasing the second bag from the pull handle by actuating an operating button on the pull handle to retract the locking pin into the pull handle, retraction of the locking pin causing the locking switch to move into an unlocked position, whereby the auxiliary attachment adaptor is released to allow the second bag to be detached from the wheeled bag.

17. The method of claim 16, wherein the locking switch has a magnetic base and at least the tip of the locking pin is magnetic, and the locking switch is moved into the unlocked position by magnetic attraction between the magnetic base and magnetic tip of the locking pin when the locking pin tip is retracted through the hole in the pull-handle.

* * * * *